United States Patent [19]

Whalen

[11] 4,006,991

[45] Feb. 8, 1977

[54] PAINT LOADING APPLICATOR FOR A PAINTING PAD OR BRUSH

[76] Inventor: Joseph J. Whalen, 1220 SW. 24, Oklahoma City, Okla. 73109

[22] Filed: Oct. 16, 1975

[21] Appl. No.: 622,927

Related U.S. Application Data

[63] Continuation-in-part of Ser. No. 618,309, Sept. 29, 1975, abandoned.

[52] U.S. Cl. ..... 401/121; 15/257.05

[51] Int. Cl.[2] ..... A45D 39/16

[58] Field of Search ..... 401/118–121; 15/257.05, 257.06

[56] References Cited

UNITED STATES PATENTS

| | | | |
|---|---|---|---|
| 220,600 | 10/1879 | Friedlander | 15/257.05 X |
| 2,994,901 | 8/1961 | Ely | 15/257.05 |
| 3,195,169 | 7/1965 | Chadbourn | 401/119 |
| 3,688,943 | 9/1972 | Brown | 15/257.05 X |

*Primary Examiner*—Lawrence Charles
*Attorney, Agent, or Firm*—Robert K. Rhea

[57] ABSTRACT

A manually held upwardly open container for paint is provided with an upstanding back wall flange forming a stop for disposing a painting pad in an overlying position on the container open end. Paint is applied to the overlying painting pad by temporarily inverting the container. The periphery of the container is provided with a paint drip receiving recess.

2 Claims, 5 Drawing Figures

PAINT LOADING APPLICATOR FOR A PAINTING PAD OR BRUSH

CROSS REFERENCE TO RELATED APPLICATION

This application is a continuation-in-part of an application filed by me in the U.S. Patent and Trademark Office on Sept. 29, 1975, Ser. No. 618,309 for PAINT LOADING APPLICATOR FOR A PAINTING PAD OR BRUSH, now abandoned.

BACKGROUND OF THE INVENTION

1. Field of the Invention.

The present invention relates to painting equipment and more particularly to a paint container for loading a selected area of a painting pad or brush with paint.

It is common practice, when painting small area surfaces, such as decorative molding, cornices and other uneven surfaces, normally found around or near window areas, such as a stile or mullion adjacent a glazed surface, to use a relatively small generally rectangular painting pad having a section of fibrous pile on one flat surface which is loaded with paint and transferred to the area to be painted by manually moving the painting pad across the surface. The principal problem associated with such painting is loading the painting pad pile with a sufficient quantity of paint to paint the desired surface and yet prevent excess or unwanted paint being deposited on an adjacent surface, such as an adjoining wall, window pane or a different colored surface.

The present invention simplifies and for the most part eliminates the problem of overloading a painting pad with paint by providing a container having a stop and adjoining surface area disposed normal to the plane of the stop so that only a selected area of the painting pad will be loaded with paint. Any excess paint on the painting pad is easily removed in a wiping action of the pad across the paint receiving surface of the painting pad in contact with the container.

2. Description of the Prior Art.

It has been common practice to load the painting surface of a painting pad by providing a shallow container, such as an inverted gallon size paint container lid, having a relatively small quantity of paint disposed thereon so that the painting pad painting surface may be flatly engaged with the paint. Loading the painting pad in this fashion results in the entire paint receiving surface of the painting pad being loaded with paint which, when the painting pad is placed on a surface to be painted, adjacent a adjoining wall or surface, some of the paint from the painting pad pile is invariably transferred to the surface of the adjoining wall. This results in an uneven fresh painted edge or area presenting an untidy and unprofessional appearance.

This invention obviates the overloading of a painting pad surface and simplifies the forming of a true painted edge surface by applying paint to the central portion of the painting pad pile while maintaining a marginal edge portion thereof substantially free of paint. The principal distinction between this application and the above named copending application is that the walls of the container disclosed herein are of substantially uniform thickness as opposed to an excessively thickened rearward wall thus conserving material and simplifying construction.

SUMMARY OF THE INVENTION

A manually held upwardly open generally ovate in transverse section container is provided with an upstanding rearward flange projecting above the plane of the open end forming a stop engaged by a marginal edge of a painting pad when flatly overlying the open end of the container. A shelf-like upper surface or ledge, extending between the upper limit of the back wall and the stop, prevents paint in the container contacting the paint receiving pile of that portion of the paint pad overlying the ledge when the container is temporarily inverted to load the painting pad pile with paint. A part-circular ring, forming an upwardly open recess, transversely surrounds the major portion of the container adjacent its upwardly open end for collecting excess paint moving by gravity along the exterior surface of the container walls as a result of the painting pad moving across the upper end surface of the container walls in a direction away from the back stop for removing excess paint from the painting pad pile. A brush, capable of being inserted into the container, may be loaded with paint and the excess paint removed therefrom by drawing the brush bristles actoss the upper end surface of the container wall opposite the back stop.

The principal objects of this invention are to provide a paint applicator for loading the pile of a painting pad with paint while maintaining at least one marginal edge portion thereof free of paint and which may be easily used for loading a paint brush with paint and removing excess paint therefrom wherein excess paint on the exterior wall surface of the applicator is collected by a drip-rail-like recess.

DESCRIPTION OF THE PREFERRED EMBODIMENT

Figure 1:
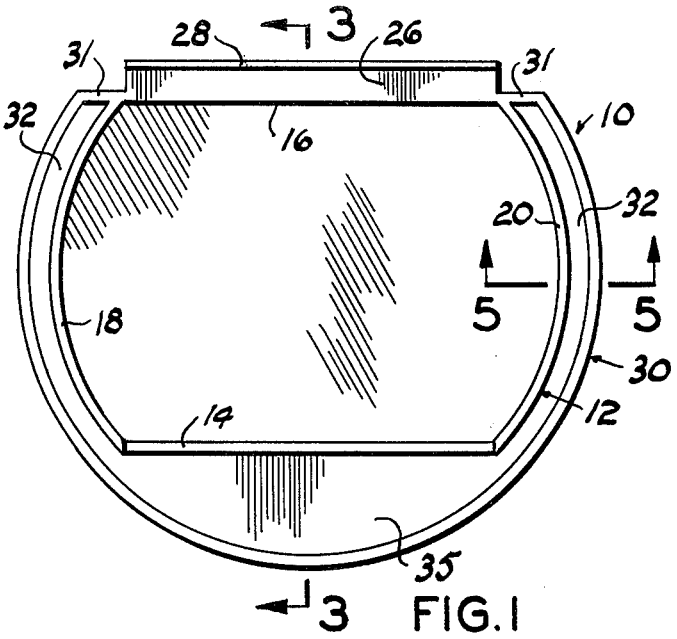
FIG. 1 is a top view of the paint container applicator.
Figure 4:
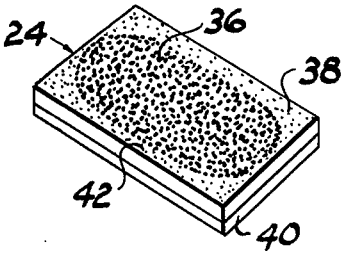
FIG. 4 is a perspective view of a painting pad having its paint receiving pile disposed upwardly and illustrating the initial position of paint when applied thereto by the paint containing applicator; and, FIG. 5 is a fragmentary vertical cross sectional view taken substantially along the line 5—5 of FIG. 1.
Figure 5:
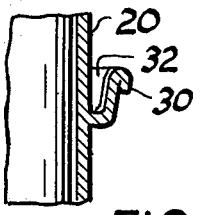
Figure 2:
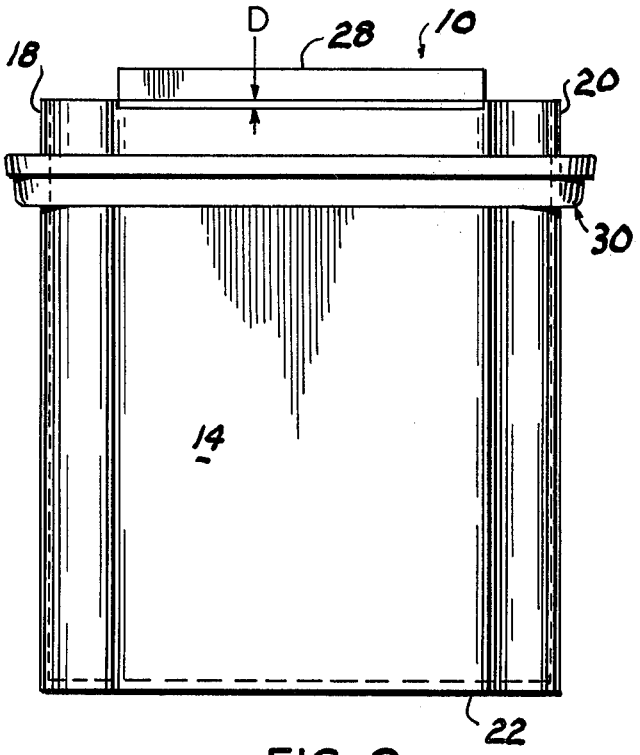
FIG. 2 is a front elevational view of FIG. 1.

Like characters of reference designate like parts in those figures of the drawings in which they occur.

In the drawings:

The reference numeral 10 indicates the paint containing applicator, as a whole, comprising an upwardly open receptacle 12 defined by parallel front and back walls 14 and 16, respectively, integrally interconnected by arcuate end walls 18 and 20 defining a generally ovate-shape in transverse cross section with the walls being integrally joined to a bottom wall 22. The size of the applicator 10 is relatively small, for example, approximately 4 inches (10.16cm) along its major axis, between the end walls 18 and 20, so that a conventional rectangular small area painting pad 24, when placed thereon, spans the distance between the side walls and extends, at its marginal end edge portions, beyond the limits of the respective end walls 18 and 20 for the purposes presently apparent.

The vertical height of the front wall 14 is less than the back and end walls by a predetermined distance or dimension D for regulating the thickness of a coating of paint applied to the painting pad 24 as hereinafter explained.

A relatively narrow shelf-like ledge 26, coextensive with the back wall, forms a horizontal surface terminating in a short upstanding back flange to form a stop 28 for the purposes presently explained.

A part-circular rim 30 transversely encompasses a substantial portion of the container 12 in a downwardly spaced relation with respect to the plane of the upper end surface of the container walls and terminates rearwardly at its respective ends by rim end walls 31 in the plane of the back surface of the back wall 16. The rim 30 forms an upwardly open substantially V-shaped recess 32 adjacent the outer surface of the end walls 18 and 20 and is joined to the container front wall 14 by a horizontal ledge portion 34 lying in the plane of the depending limit of the rim 30 to form a drip receptacle 35. The purpose of the ring recess 32 and the drip receptacle 35 is to collect excess paint dripping off the exterior surfaces of the container walls, as hereinafter explained.

OPERATION

Figure 3:
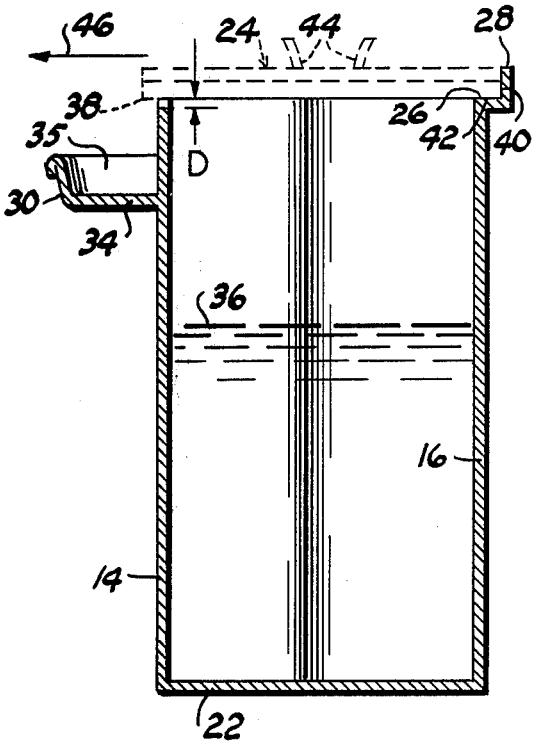
FIG. 3 is a vertical cross sectional view taken substantially along the line 3—3 of FIG. 1, by broken lines, illustrating the relative position of a painting pad when in overlying relation.

In operation, a selected quantity of paint 36 is placed within the receptacle 12 and assuming the painting pad 24 is to be used for painting a selected surface, the painting pad 24 is flatly disposed in overlying relation on the upper end surface of the receptacle walls with its paint receiving layer of pile 38, or the like, disposed downwardly, as viewed in FIG. 3. In this position one longitudinal edge, such as the edge 40 of the painting pad, abuts the back stop 28 so that a marginal edge portion 42 of the painting pad pile is in overlying contiguous contact with the upper surface of the back wall ledge 26. The applicator is manually grasped, by one hand, of the operator and, with his other hand holding the handle portions 44 of the painting pad, the applicator 10 is temporarily inverted while maintaining the painting pad in contiguous contact with the upper end surface of the receptacle walls. Thus, the painting pad pile 38 is loaded with a quantity of the paint 36, as indicated by the darker shaded area of the painting pad pile (FIG. 3). With the applicator 10 again upright the operator manually moves the painting pad 24, in the direction of the arrow 46, forwardly of the container, while maintaining the pile in contact with the receptacle end walls to remove excess or overloaded paint from the pile. The front wall 14, by being disposed below the plane of the remaining walls, leaves a coat of paint 36 on the pad with the thickness of such coat being determined by the dimension D and pressure manually applied to the pad. A little experience, by trial and error, will quickly determine the pressure to be manually applied to the painting pad to retain a desired density of the paint on the pile during this wiping action. Any paint removed from the pile tending to run or drip down the outer surface of the end walls or front wall will then be collected by the rim recess 32 and drip receptacle 35.

The use of the applicator 10, in combination with a painting brush, seems obvious in that the brush, not shown, is dipped into the paint 36 to load the bristles thereof and thereafter the bristles are manually drawn across the forward receptacle wall 14 in a wiping action wherein the arcuate configuration of the end walls tend to draw the bristles of the brush together.

The receptacle 12 is easily cleaned, after pouring unused paint 36 into a permanent storage container, by using a suitable solvent. Any paint drying in the rim recess 32 or drip receptacle is similarly easily removed, as by inserting a suitable tool, such as a scraper into the drip collecting area.

Obviously the invention is susceptible to changes or alterations without defeating its practicability. Therefore, I do not wish to be confined to the preferred embodiment shown in the drawings and described herein.

I claim:

1. A rectangular paint containing painting pad paint applicator, comprising:

an upwardly open container having front, back and end walls;

a horizontal ledge secured to the upper limit of said back wall; and, an upstanding flange secured to the rearward limit of said ledge and forming a back stop adapted for contacting and supporting a longitudinal marginal edge of a painting pad when superposed on said applicator, whereby a painting pad, while overlying the open end of said applicator against said stop, is coated with paint in an area equal to the open end area of the applicator when the applicator and painting pad are simultaneously temporarily inverted.

2. The paint applicator according to claim 1 in which the upper end surface of said front wall is disposed below the plane of the upper end surface of the other said walls and predetermined distance for controlling the thickness of a layer of paint deposited on said painting pad.

* * * * *